US010084256B2

(12) United States Patent
Zhao

(10) Patent No.: US 10,084,256 B2
(45) Date of Patent: Sep. 25, 2018

(54) ELECTRICAL CONNECTOR HAVING ADJACENT GROUND AND POWER CONTACTS WITH TAIL PORTIONS INTERPOSED BY SIGNAL CONTACT TAIL PORTION

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/815,688

(22) Filed: Nov. 16, 2017

(65) Prior Publication Data

US 2018/0138621 A1 May 17, 2018

(30) Foreign Application Priority Data

Nov. 16, 2016 (CN) ..... 2016 1 1006324

(51) Int. Cl.

| | |
|---|---|
| ***H01R 24/00*** | (2011.01) |
| ***H01R 13/05*** | (2006.01) |
| ***H01R 13/502*** | (2006.01) |
| ***H01R 11/03*** | (2006.01) |
| ***H01R 13/648*** | (2006.01) |

(52) U.S. Cl.

CPC ..... *H01R 13/05* (2013.01); *H01R 11/03* (2013.01); *H01R 13/502* (2013.01); *H01R 13/648* (2013.01)

(58) Field of Classification Search

CPC ..... H01R 23/7073; H01R 23/7005; H01R 13/2442

USPC ..... 439/660, 626, 374, 377, 79, 733

See application file for complete search history.

(56) References Cited

U.S. PATENT DOCUMENTS

| | | | | |
|---|---|---|---|---|
| 8,808,029 | B2 * | 8/2014 | Castillo | H01R 13/6585 439/607.05 |
| 9,728,899 | B2 * | 8/2017 | Peng | H01R 13/6581 |
| 2016/0118750 | A1 * | 4/2016 | Guo | H01R 13/6585 439/78 |

FOREIGN PATENT DOCUMENTS

| | | |
|---|---|---|
| CN | 105322341 | 2/2016 |
| CN | 105449444 | 3/2016 |

* cited by examiner

*Primary Examiner* — Phuong Chi T Nguyen

(74) *Attorney, Agent, or Firm* — Wei Te Chung; Ming Chieh Chang

(57) ABSTRACT

An electrical connector includes: an insulative housing having a base and a tongue; an upper and lower rows of contacts arranged in the insulative housing and exposed to the tongue, each contact having a contacting portion, a tail portion, and an intermediate portion, each row of contacts including an outermost ground contact, a power contact adjacent to the ground contact, and plural signal contacts; and a shielding shell enclosing the insulative housing; wherein the contacting portions of the ground and power contacts are next to each other; the tail portion of the ground contact in the upper row of contacts is next to at least one signal contact tail portion in the lower row of contacts; and the tail portion of the ground contact in the lower row of contacts is next to at least one signal contact tail portion in the upper row of contacts.

4 Claims, 9 Drawing Sheets

| A1 | A2 | A3 | A4 | A5 | A6 | A7 | A8 | A9 | A10 | A11 | A12 |
|---|---|---|---|---|---|---|---|---|---|---|---|
| | | | | CC1 | D+ | D− | SBU1 | Vbus | | | GND |
| GND | | | Vbus | SBU2 | D− | D+ | CC2 | | | | |
| B12 | B11 | B10 | B9 | B8 | B7 | B6 | B5 | B4 | B3 | B2 | B1 |

FIG. 8

| A12 | B5 | B6 | A9 | A8 | A7 | B7 | B8 | B9 | A6 | A5 | B12 |
|---|---|---|---|---|---|---|---|---|---|---|---|
| GND | CC2 | D+ | Vbus | SBU1 | D− | D− | SBU2 | Vbus | D+ | CC1 | GND |

FIG. 9

ELECTRICAL CONNECTOR HAVING ADJACENT GROUND AND POWER CONTACTS WITH TAIL PORTIONS INTERPOSED BY SIGNAL CONTACT TAIL PORTION

BACKGROUND OF THE INVENTION

1. Field of the Invention

The present invention relates to a dual orientation electrical connector including adjacent ground and power contacts having tail portions interposed by signal contact tail portion or portions.

2. Description of Related Arts

China Patent No. 105449444 discloses a dual orientation connector comprising an insulative housing, two rows of terminals arranged in the insulative housing, and a shielding shell enclosing the insulative housing. Each terminal has a contacting portion, a securing portion, and a tail portion. Each row of terminals include an outermost ground contact, a power contact next to the ground contact, and plural signal contacts.

China Patent No. 105322341 discloses a similar dual orientation connector wherein each of two rows of contacts include two outermost ground contacts and two inwardly adjacent power contacts. Tail portions of the two rows of contacts are arranged in a line and may be interposed.

SUMMARY OF THE INVENTION

An electrical connector comprises: an insulative housing having a base and a tongue; an upper and lower rows of contacts arranged in the insulative housing and exposed respectively to an upper and lower surfaces of the tongue, each contact having a contacting portion, a tail portion, and an intermediate portion between the contacting portion and the tail portion, each row of contacts including an outermost ground contact, a power contact adjacent to the ground contact, and plural signal contacts; and a shielding shell enclosing the insulative housing; wherein the contacting portions of the ground and power contacts are next to each other; the tail portion of the ground contact in the upper row of contacts is next to at least one signal contact tail portion in the lower row of contacts; and the tail portion of the ground contact in the lower row of contacts is next to at least one signal contact tail portion in the upper row of contacts.

BRIEF DESCRIPTION OF THE DRAWING

FIG. 8 shows a schematic diagram of contact positions for front contacting portions of the two rows of contacts; and FIG. 9 shows a schematic diagram of contact positions for rear tail portions of the two rows of contacts.

DETAILED DESCRIPTION OF THE PREFERRED EMBODIMENT

Figure 1:
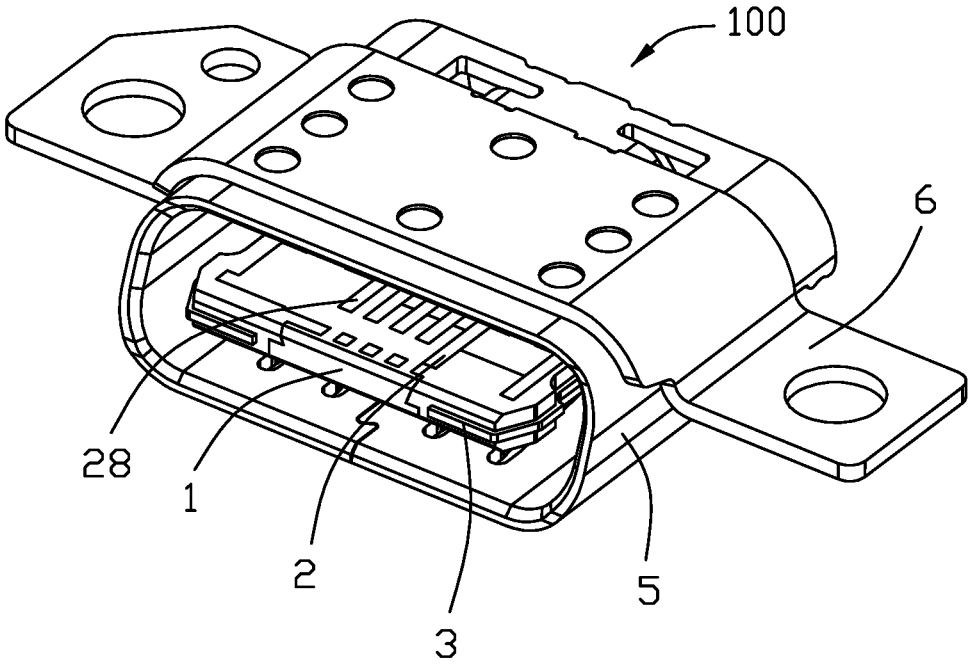
FIG. 1 is a perspective view of an electrical connector in accordance with the present invention.
Figure 2:
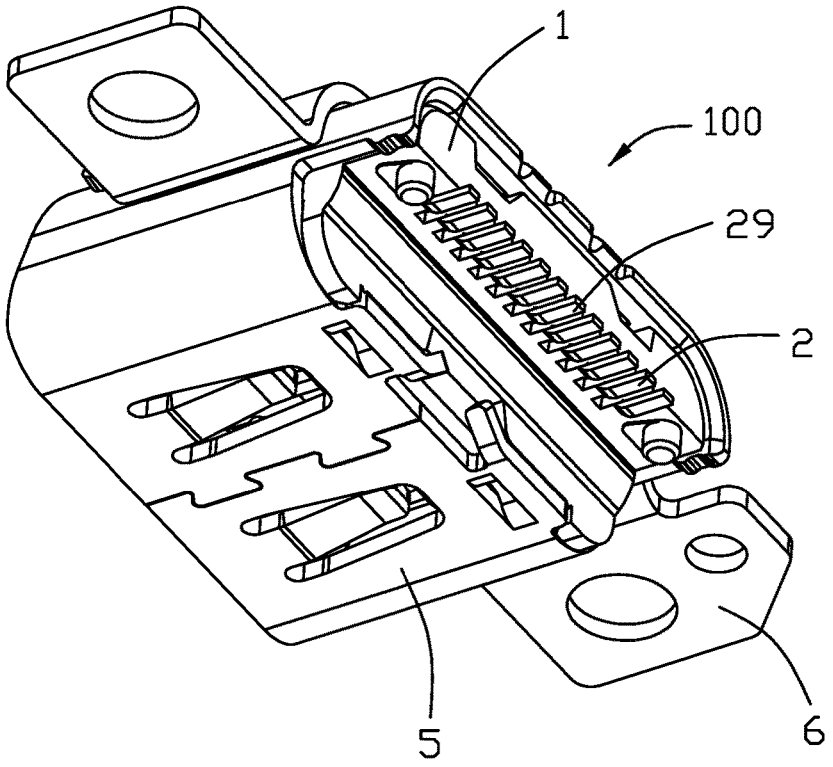
FIG. 2 is another perspective view of the electrical connector.
Figure 3:
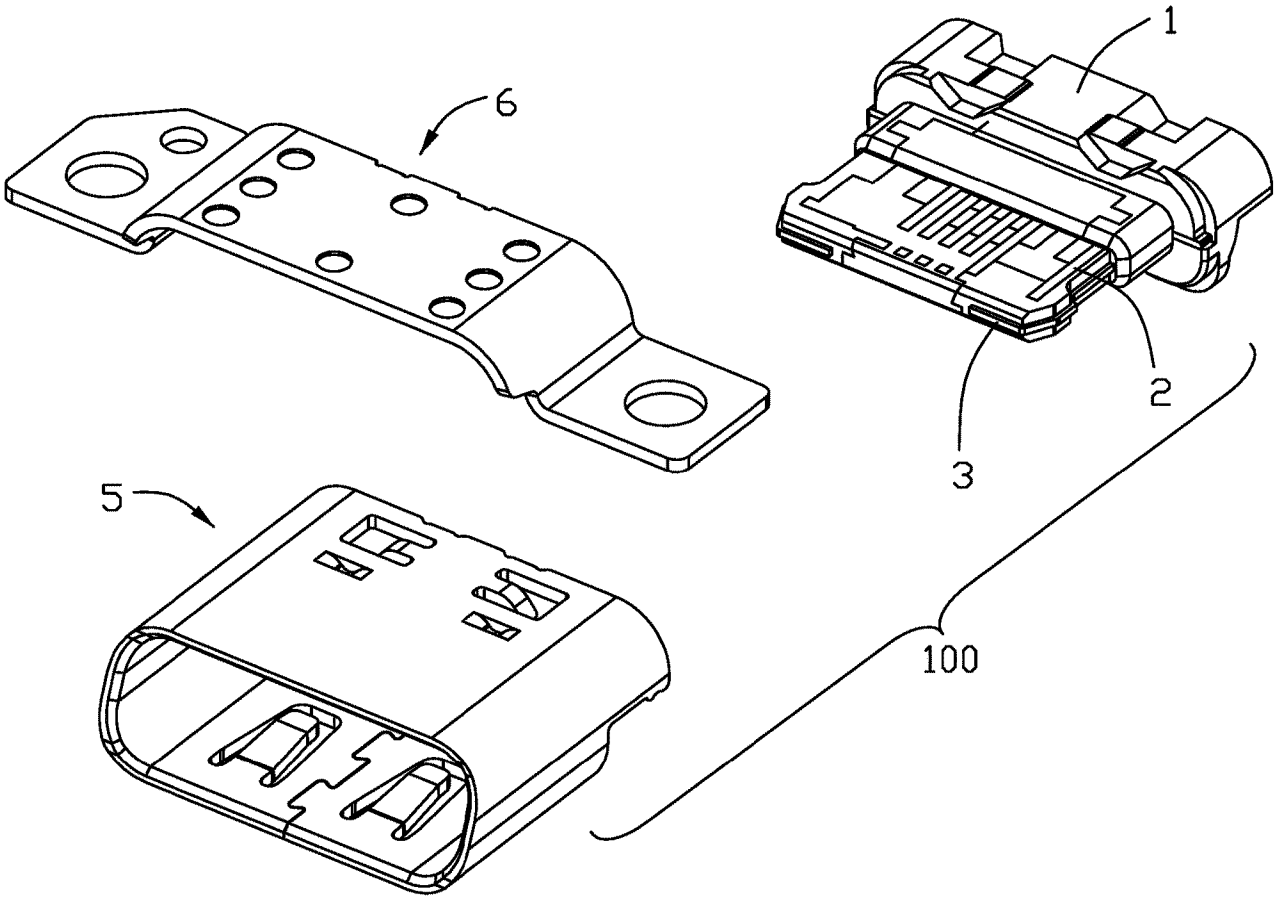
FIG. 3 is an exploded view of the electrical connector.

Referring to FIGS. 1-4, an electrical connector 100 comprises an insulative housing 1, two rows of contacts 2 arranged in the insulative housing 1, and a shielding shell 5 enclosing the insulative housing 1. The electrical connector 100 may further comprise a metallic plate 3 arranged in the insulative housing 1 between the two rows of contacts 2, a metal cover 6 attached to a bottom of the shielding shell 5. The metallic plate 3 has two opposite latching sides.

Figure 4:
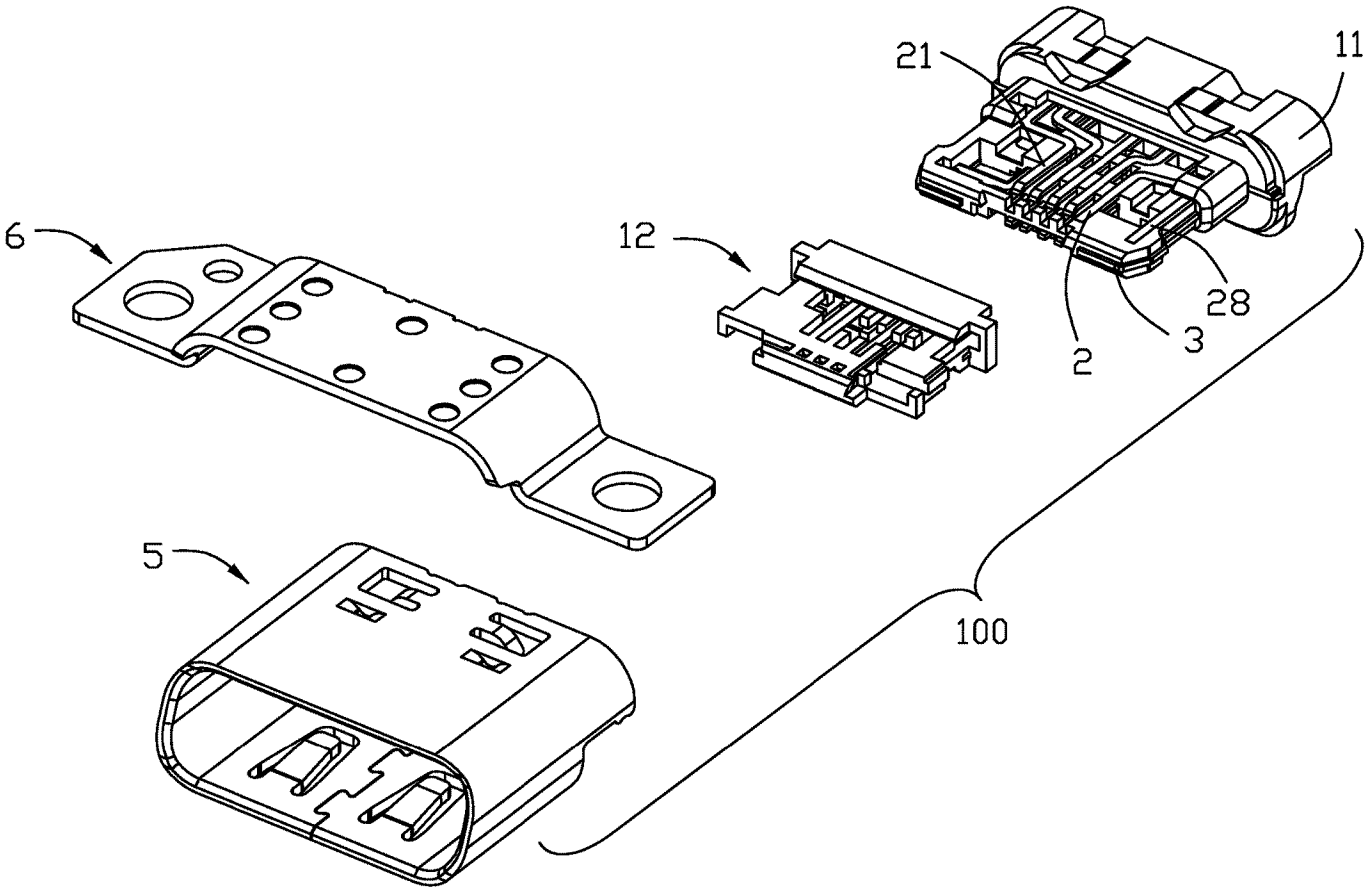
FIG. 4 is a further exploded view of the electrical connector in FIG. 3.
Figure 5:
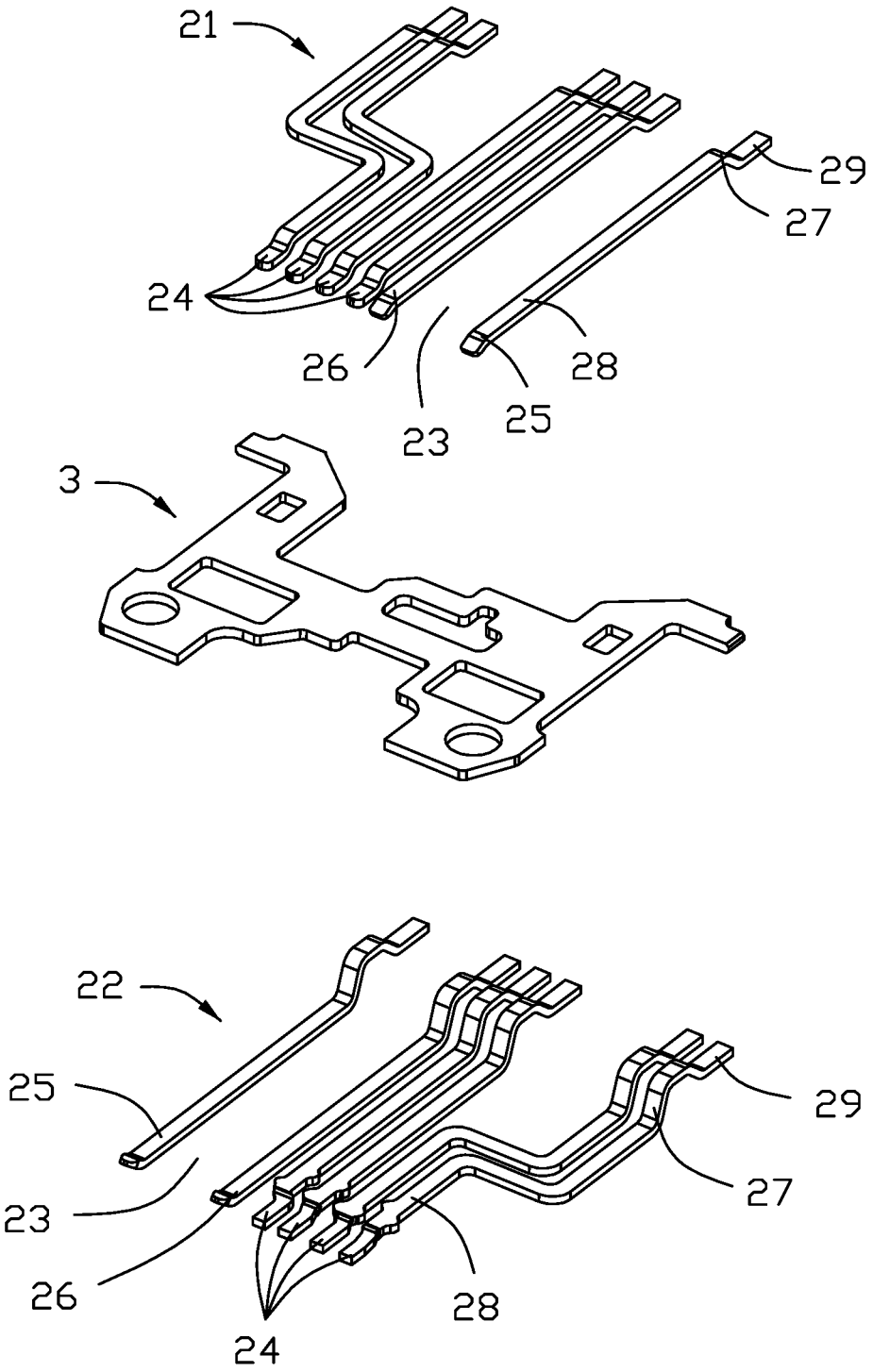
FIG. 5 is an exploded view of two rows of contacts and a middle metallic plate of the electrical connector.

As shown in FIG. 4, the insulative housing 1 includes a first body 11 insert molded with the contacts 2 and a second body 12 further over-molding the insert-molded first body and contacts.

Figure 6:
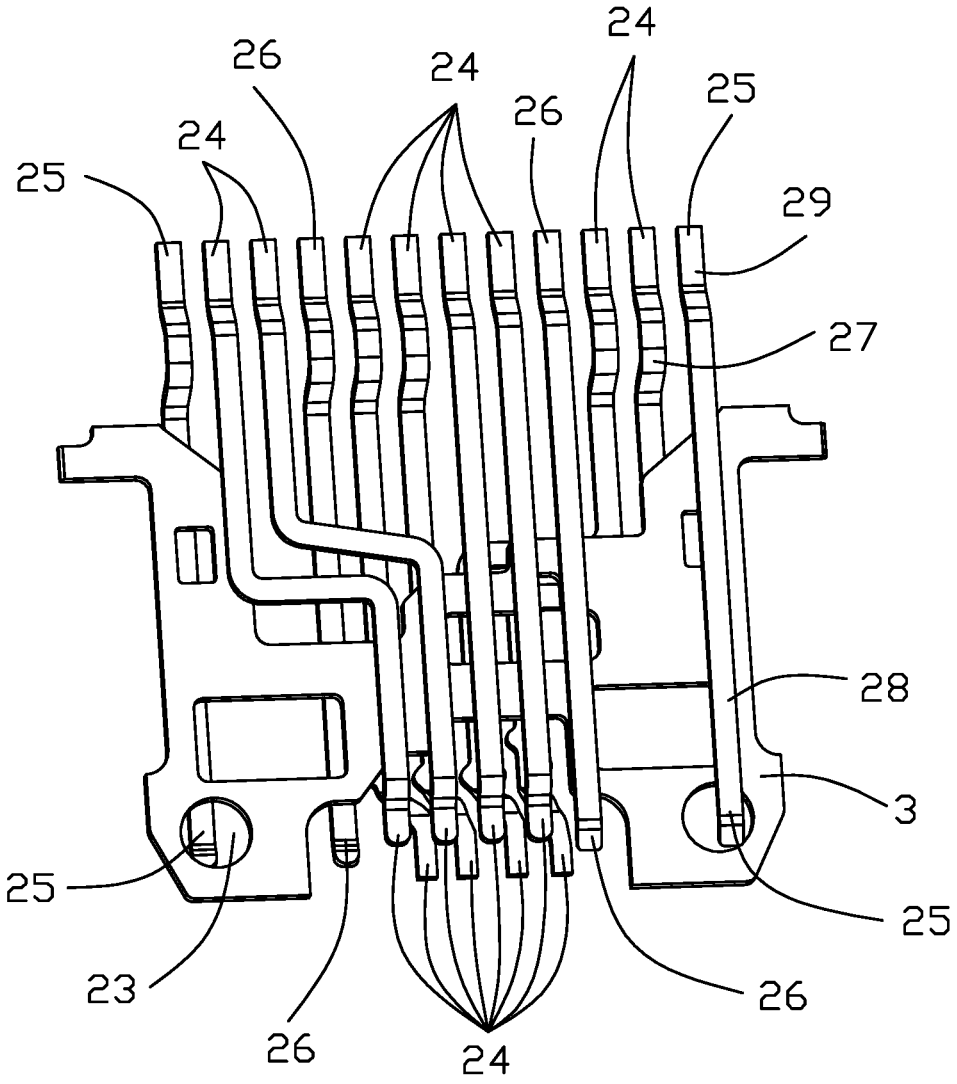
FIG. 6 is a schematic assembled view of the two rows of contacts and metallic plate in FIG. 5.
Figure 7:
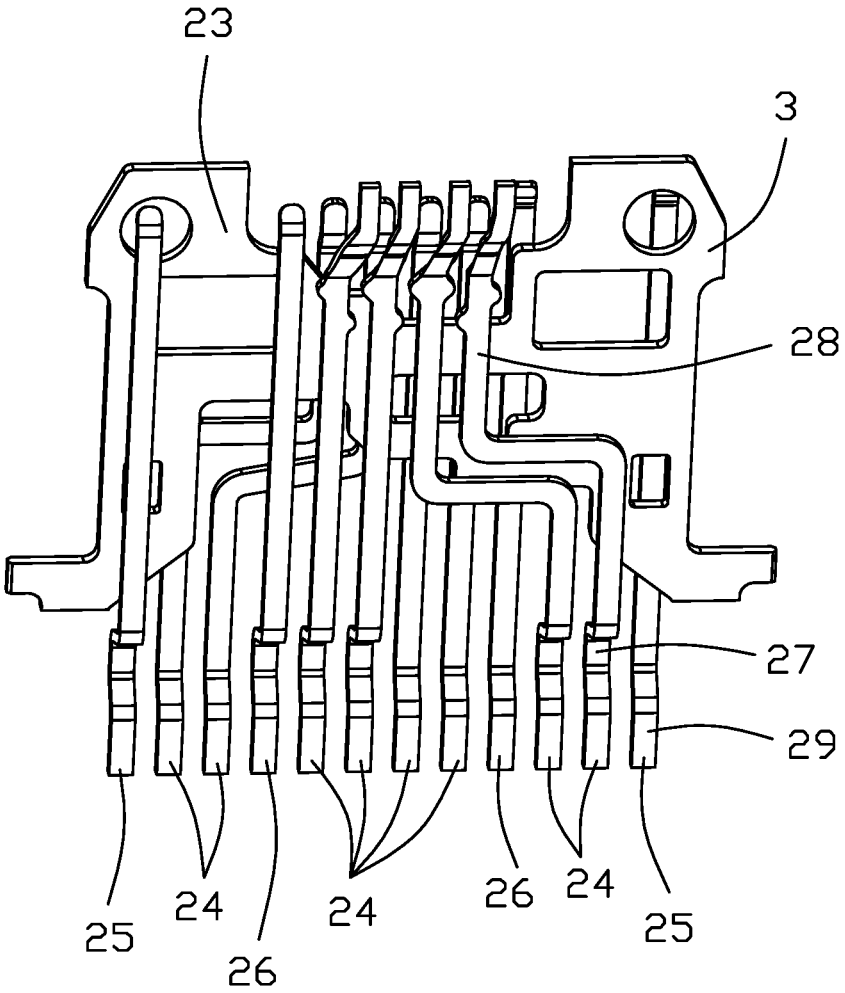
FIG. 7 is a view similar to FIG. 6 but from a different perspective.

Referring to FIGS. 5-8, each row of contacts include an outermost ground contact 25, a power contact 26 adjacent to the ground contact 25, and plural signal contacts 24. Each contact has a contacting portion 28, a tail portion 29 for soldering to a printed circuit board, and an intermediate portion 27 between the contacting portion and the tail portion. The contacting portions 28 of the upper row of contacts 21 and the lower row of contacts 22 are reversely-symmetrically arranged to achieve dual orientations, i.e., mutable with a complementary connector in either of two orientations. Each row of contacts have six (6) contacts, including one ground contact 25, one power contact 26, and four signal contacts 24. In FIG. 8, "GND" stands for ground contact, "Vbus" for power contact, "SBU1" and "SBU2" for auxiliary signal contacts, "D−" for USB 2.0 negative signal contact, "D+" for USB 2.0 positive signal contact, and "CC1" and "CC2" for detect (signal) contacts. In standard receptacle connector contacts arrangement, positions 5, 6, 7, 8, 9, and 12 correspond to detect contact, USB 2.0 positive signal contact, USB 2.0 negative signal contact, auxiliary signal contact, power contact, and ground contact, respectively. The detect contact, USB 2.0 positive and negative signal contacts, and auxiliary signal contact are collectively termed signal contacts. Referring to FIGS. 6-7 and 9, the tail portions 28 of the contacts 2 are aligned in a line, from left to right, in the order of contacts GND, CC2, D+, Vbus, SBU1, D−, D−, SBU2, Vbus, D+, CC1, and GND. In other embodiments, the number of the contacts and their arrangement may be changed. The four signal contacts 24 in the upper row 21 and the four signal contacts 24 in the lower row 22 are aligned in a vertical direction. Respective front ends of the contacting portions 28 are buried in the insulative housing 1. In the upper row of contacts 21, the front ends of the four signal contacts 24 are rearwardly of the front ends of the two power and ground contacts 26 and 25 along a front-to-back mating direction; in the lower row of contacts 22, the front ends of the four signal contacts 24 are forwardly of the front ends of the two power and ground contacts 26 and 25 along the mating direction.

In this invention, between the tail portions 29 of adjacent ground and power contacts 26 and 25, there is at least one signal contact tail portion 29. In the embodiment shown, in each of the upper and lower rows of contacts, there are two signal contact tail portions 29 between the tail portions 29 of adjacent ground and power contacts 26 and 25. In this embodiment, there are a vacant space 23 for two contact positions between the contacting portions 28 of the ground and power contacts 26 and 25 in the upper row of contacts 21. There are also a vacant space 23 for two contact positions between the contacting portions 28 of the ground and power contacts 26 and 25 in the lower row of contacts 22. Between the tail portion 29 of the power contact 26 in the upper row of contacts 21 and the tail portion 29 of the power contact 26 in the lower row of contacts 22 are the tail portions 29 of plural signal contacts 24.

In this embodiment, between the tail portions 29 of the power and ground contacts 26 and 25 in the upper row of contacts 21, there are two signal contacts tail portions 29 of the lower row of contacts 22; between the tail portions 29 of the power and ground contacts 26 and 25 in the lower row of contacts 22, there are two signal contacts tail portions 29 of the upper row of contacts 21. Between the tail portion 29 of the power contact 26 in the upper row of contacts 21 and the tail portion 29 of the power contact 26 in the lower row of contacts 22, there are the tail portions 29 of two signal contacts 24 from the upper row of contacts 21 and the tail portions 29 of two signal contacts 24 from the lower row of contacts 22. The number and/or positions of signal contact tail portions between the contact tail portions of adjacent power and ground contacts in the same row or between the contact tail portions of the power contact from the upper row and the ground contact from the lower row may be changed according to particular applications. In brief, in this embodiment on the opposite surface of the tongue, each row has twelve positions (A1~A12 and B1~B12), while only six positions (A5-A9, A12 and B5~B9, B12), are occupied wherein in reach row the power contact and the ground contact are located at the positions with the two largest numbers A9, A12 and B9, B12 with two empty positions therebetween so as to allow the tail portions of the signal contacts at the positions with the two lowest numbers in the other row to occupy the corresponding two empty positions at the back side of the housing 1. Notably, in this embodiment the pitch between the adjacent positions on the tongue and that at the back side of the housing are same with each other so as to have the positions on the tongue and that at the back side of the housing are aligned with each other in the front-to-back direction. Also in this embodiment the upper row of contacts and the lower row of contacts are essentially reversed symmetrical with each other and only have one half of the total position numbers, thus resulting in a single row of tail portions easily.

The provision of at least one signal contact tail portion 29 between the tail portions 29 of adjacent ground and power contacts 26 and 25 increases the distance between the tail portion of the ground contact and the tail portion of the power contact to obviate a shorting risk due to conduction of large current or during soldering the tail portions.

What is claimed is:

1. An electrical connector comprising:

an insulative housing having a base, and a tongue extending forwardly from the base along a front-to-back direction and defining opposite upper and lower surfaces in a vertical direction perpendicular to said front-to-back direction;

the tongue defining a plurality of positions along a transverse direction perpendicular to both said front-to-back direction and said vertical direction;

an upper and lower rows contacts arranged in the insulative housing, each contact having a contacting portion, a tail portion, and an intermediate portion between the contacting portion and the tail portion along the front-to-back direction, the contacting portions of the upper row contacts exposed on the corresponding positions of the upper surface and the contacting portions of the lower row contacts exposed on the corresponding positions of the lower surface in a reversed symmetrical manner with regard to a center of the tongue while the tail portions of the upper row and the lower row contacts being arranged in only one row;

each row of contacts including a ground contact, a power contact, and plural signal contacts;

the contacting portions of the ground and power contacts in a same row directly facing to each other with some vacant positions therebetween in the transverse direction;

the tail portion and the contacting portion of the same ground contact aligned with each other along the front-to-back direction;

the tail portion and the contacting portion of the same power contact aligned with each other along the front-to-back direction; and the tail portion of the ground contact and the tail portion of the power contact in the same row are separated from each other by the tail portion of at least one of the signal contact in the other row;

a shielding shell enclosing the insulative housing; wherein the contacting portions of the ground and power contacts are next to each other;

wherein said tail portion of the at least one signal contact is offset from the corresponding contacting portion of the same signal contact in the transverse direction.

2. The electrical connector as claimed in claim 1, wherein there are tail portions of two signal contacts arranged between the tail portions of adjacent ground and power contacts in each row of contacts.

3. The electrical connector as claimed in claim 1, wherein the tail portions of the upper and lower rows of contacts are arranged in a line.

4. The electrical connector as claimed in claim 1, wherein said at least one signal contact in the upper row is closest to the ground contact and the power contact in the lower row, and said at least one signal contact in the lower row is closer to the ground contact and the power contact is the upper row.

* * * * *